US012662224B1

(12) United States Patent
Mirly et al.

(10) Patent No.: US 12,662,224 B1
(45) Date of Patent: Jun. 23, 2026

(54) EXTENSION JOINT FOR A MARINE DRIVE

(71) Applicant: Brunswick Corporation, Mettawa, IL (US)

(72) Inventors: Luke Mirly, Rolla, MO (US); Thomas F. Nickols, Brownsville, TX (US); Andrew T. O'Neill, Fond du Lac, WI (US); Brennen David, Rolla, MO (US)

(73) Assignee: Brunswick Corporation, Mettawa, IL (US)

( * ) Notice: Subject to any disclaimer, the term of this patent is extended or adjusted under 35 U.S.C. 154(b) by 414 days.

(21) Appl. No.: 18/504,721

(22) Filed: Nov. 8, 2023

(51) Int. Cl.
*B63H 20/16* (2006.01)
*B63H 20/14* (2006.01)
*B63H 20/32* (2006.01)

(52) U.S. Cl.
CPC ..... *B63H 20/16* (2013.01); *B63H 20/32* (2013.01); *B63H 2020/145* (2013.01)

(58) Field of Classification Search
CPC ..... B63H 20/00; B63H 20/08; B63H 20/10; B63H 20/14; B63H 2020/103; B63H 20/106; B63H 2020/145
USPC ..... 440/62, 63, 65, 76, 78, 84, 86
See application file for complete search history.

(56) References Cited

U.S. PATENT DOCUMENTS 1,385,130 A 7/1921 Hooke
3,881,443 A 5/1975 Hamp
4,056,074 A 11/1977 Sachs
4,907,994 A 3/1990 Jones
6,213,821 B1 4/2001 Bernloehr
6,475,560 B2 11/2002 Dodd
7,163,427 B1 1/2007 Lee
8,936,498 B1 1/2015 Lee
9,896,175 B2 * 2/2018 Galletta, Jr. ..... G06F 3/065
10,392,091 B2 * 8/2019 Galletta, Jr. ..... G06F 3/061
10,800,502 B1 10/2020 Alby et al.
11,068,297 B2 * 7/2021 Galletta, Jr. ..... B63H 20/32
11,292,568 B2 * 4/2022 Galletta, Jr. ..... G06F 3/0604
11,780,548 B2 * 10/2023 Galletta, Jr. ..... B63H 20/32 718/1
11,866,133 B1 1/2024 Mueller
2011/0111654 A1 5/2011 Porta

* cited by examiner

*Primary Examiner* — Daniel V Venne
(74) *Attorney, Agent, or Firm* — Andrus Intellectual Property Law, LLP

(57) ABSTRACT

An extension joint device for a marine drive comprises a first cylinder and a second cylinder which is telescopically extendable and retractable relative to the first cylinder to adjust a length of the extension joint. Together, the first and second cylinders define a sealed cylindrical cavity which is extended and retracted upon extension and retraction of the second cylinder relative to the first cylinder, respectively. an electrical connector extends through the extension joint, the electrical connector having a helical shape in the sealed cylindrical cavity which is extended and compressed upon extension and retraction of the second cylinder relative to the first cylinder. A slip ring, through which the electrical connector extends, is configured to permit rotation of a first portion of the electrical connector relative to a second portion of the electrical connector, thereby facilitating compression and extension of the helical shape.

20 Claims, 7 Drawing Sheets

EXTENSION JOINT FOR A MARINE DRIVE

FIELD

The present disclosure relates to marine drives for propelling a marine vessel in water, and particularly to marine drives having an adjustable midsection.

BACKGROUND

The following U.S. Patents provides background and are incorporated herein by reference:

U.S. Pat. No. 6,475,560 discloses an outboard motor including an internal combustion engine and an adapter plate having an upper end that supports the engine and a lower end formed as a cylindrical neck. A driveshaft housing is below the adapter plate has an integral oil sump collecting oil that drains from the engine and through the adapter plate neck. One or more bearings couple the adapter plate neck to the oil sump such that the driveshaft housing is suspended from and rotatable with respect to the adapter plate. A driveshaft is coupled to a crankshaft of the engine and extends along a driveshaft axis through the adapter plate neck, bearing(s), and oil sump. A steering actuator is coupled to and rotates the oil sump, and thus the driveshaft housing, around the driveshaft axis with respect to the adapter plate, which varies a direction of the outboard motor's thrust.

U.S. Pat. No. 10,800,502 discloses an outboard motor that has a powerhead that causes rotation of a driveshaft and a steering housing located below the powerhead, wherein the driveshaft extends from the powerhead into the steering housing. A lower gearcase is located below the steering housing and supports a propeller shaft that is coupled to the driveshaft so that rotation of the driveshaft causes rotation of the propeller shaft. The lower gearcase is steerable about a steering axis with respect to the steering housing and powerhead.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In non-limiting examples, an outboard motor comprises an upper unit configured for attachment to a marine vessel and a lower unit suspended from the upper unit via an extension joint. The extension joint is configured so that the lower unit is movable towards and away from the upper unit. An electrical connector is coupled to a propulsor in the lower unit, the electrical connector extending from the upper unit to the lower unit through the extension joint.

In independent embodiments, the electrical connector may have a helical shape in the extension joint. The helical shape may be compressed and extended when the lower unit is moved towards and away from the upper unit, respectively. In independent embodiments, the electrical connector may comprise a first connector cable and a second electrical connector which are intertwined together to form a double helical shape. In independent embodiments, the outboard motor may comprise a slip ring through which the electrical connector extends. The slip ring may be configured to permit rotation of a first portion of the electrical connector relative to a second portion of the electrical connector, thereby facilitating compression and extension of the helical shape.

In independent embodiments, the outboard motor may comprise a protective sheath in the extension joint. The protective sheath may have a helical shape and contain the helical shape of the electrical connector.

In independent embodiments, the extension joint may be a telescopic extension joint.

In independent embodiments, the extension joint may comprise first and second cylinders which together define a sealed cylindrical cavity, and the electrical connector may extend through the sealed cylindrical cavity. In independent embodiments, the electrical connector may have a helical shape in the sealed cylindrical cavity, and the helical shape may be compressed and extended when the lower unit is moved towards and away from the upper unit. In independent embodiments, the first cylinder may be fixedly coupled to the upper unit and the second cylinder may be fixedly coupled to the lower unit. Moving the lower unit towards and away from the upper unit may cause the second cylinder to telescope up and down relative to the first cylinder. In independent embodiments, the outboard motor may comprise sliding seals between the first cylinder and the second cylinder. In independent embodiments, the electrical connector may have a helical shape in the sealed cylindrical cavity, and telescoping the second cylinder upwards and downwards relative to the first cylinder may compress and extend the helical shape, respectively.

In independent embodiments, the electrical connector may have a first end coupled to the propulsor, a second end coupled to a source of electricity in the upper unit, and a helical shape between the first end and the second end. Moving the lower unit towards and away from the upper unit may compress and extend the helical shape, respectively. In independent embodiments, the propulsor may comprise an electric motor which is electrically coupled to the electrical connector. In independent embodiments, the outboard motor may comprise a slip ring through which the electrical connector extends. The slip ring may be configured to permit rotation of a first portion of the electrical connector relative to a second portion of the electrical connector, thereby facilitating compression and extension of the helical shape.

In independent embodiments, the outboard motor may comprise an actuator configured to move the lower unit relative to the upper unit. In independent embodiments, the extension joint may comprise first and second cylinders which together define a sealed cylindrical cavity, and wherein the electrical connector extends through the sealed cylindrical cavity. The actuator may comprise a hydraulic pump which pumps a hydraulic fluid into an annulus between the first and second cylinders so as to move the lower unit relative to the upper unit.

In independent embodiments, the electrical connector may comprise an over-molded wire, and the outboard motor may comprise a protective sheath containing the electrical connector in the extension joint, the protective sheath reducing frictional abrasion of the electrical connector during movement of the lower unit relative to the upper unit.

In non-limiting examples, an outboard motor comprises an upper unit configured for attachment to a marine vessel and a lower unit suspended from the upper unit via an extension joint. The extension joint is configured so that the lower unit is movable towards and away from the upper unit. An electrical connector is coupled to an electric propulsor in the lower unit, the electrical connector extending from the upper unit to the electric propulsor through the extension joint. The electrical connector has a helical shape in the extension joint, the helical shape being compressed and extended when the lower unit is moved towards and away from the upper unit, respectively. The outboard motor comprises a slip ring through which the electrical connector extends. The slip ring is configured to permit rotation of a first portion of the electrical connector relative to a second portion of the electrical connector, thereby facilitating compression and extension of the helical shape.

In independent embodiments, the electrical connector may have a first end coupled to the electric propulsor and a second end coupled to a source of electricity in the upper unit. The helical shape extends between the first end and the second end, and moving the lower unit towards and away from the upper unit compresses and extends the helical shape, respectively. In independent embodiments, the extension joint comprises first and second cylinders which together define a sealed cylindrical cavity, and the electrical connector may extend through the sealed cylindrical cavity.

In non-limiting embodiments, an extension joint device is for a marine drive. The extension joint device comprises a first cylinder and a second cylinder which is telescopically extendable and retractable relative to the first cylinder to adjust a length of the extension joint. Together, the first and second cylinders define a sealed cylindrical cavity which is extended and retracted upon extension and retraction of the second cylinder relative to the first cylinder, respectively. An electrical connector extends through the extension joint. The electrical connector has a helical shape in the sealed cylindrical cavity which is extended and compressed upon extension and retraction of the second cylinder relative to the first cylinder. The outboard motor comprises a slip ring through which the electrical connector extends. The slip ring is configured to permit rotation of a first portion of the electrical connector relative to a second portion of the electrical connector, thereby facilitating compression and extension of the helical shape.

In independent embodiments, the slip ring may be disposed on one end of the sealed cylindrical cavity.

In independent embodiments, the slip ring may comprise a stationary part and a rotatable part which is rotatable relative to the stationary part. In independent embodiments, the rotatable part may be disposed in the sealed cylindrical cavity.

In independent embodiments, the slip ring may comprise an annular contactor and a point contactor which remains coupled to the annular contactor as the rotatable part is rotated relative to the stationary part.

In independent embodiments, the electrical connector may comprise a first connector cable and a second connector cable which are intertwined to form a double helical shape. In independent embodiments, the extension joint device may comprise sliding seals between the first cylinder and the second cylinder.

In independent embodiments, the extension joint device may comprise an actuator configured to move the second cylinder relative to the first cylinder. In independent embodiments, the actuator may comprise a hydraulic pump which pumps a hydraulic fluid into an annulus between the first and second cylinders so as to move the second cylinder relative to the first cylinder.

In independent embodiments, the extension joint device may comprise a locking mechanism movable into and between an unlocked position in which the second cylinder is extendable and retractable relative to the first cylinder and a locked position in which the second cylinder is fixed relative to the first cylinder. In independent embodiments, the locking mechanism may be configured to selectively secure the second cylinder in one of a plurality of positions relative to the first cylinder.

In independent embodiments, the electrical connector may comprise an over-molded wire and a protective sheath containing the electrical connector. The protective sheath may reduce frictional abrasion of the electrical connector during movement of the second cylinder relative to the first cylinder. In independent embodiments, the electrical connector may comprise a first connector cable and a second connector cable which are intertwined, and the protective sheath may include a first helical sleeve and a second helical sleeve on the first and second connector cables, respectively. The first and second connector cables and first and second protective sheaths may form a double helical shape. In independent embodiments, the protective sheath may have a helical shape and contains the helical shape of the electrical connector. In independent embodiments, the helical shapes of the protective sheath and the electrical connector may be extended and compressed upon extension and retraction, respectively, of the second cylinder relative to the first cylinder. In independent embodiments, the protective sheath may be made of an abrasion resistant material that is elastically deformable.

In independent embodiments, the extension joint device may comprise a protective sheath. The protective sheath may have a helical shape and contain the helical shape of the electrical connector. In independent embodiments, the helical shapes of the protective sheath and the electrical connector may be extended and compressed upon extension and retraction, respectively, of the second cylinder relative to the first cylinder. In independent embodiments, the protective sheath may have an upper helical section and a lower helical section. The upper helical section may be formed in a first circumferential direction about a vertical axis defined by the cylindrical cavity and the lower helical section may be formed in a second circumferential direction about a vertical axis that is opposite the first circumferential direction. In independent embodiments, the upper helical section may extend from an top end that is fixed relative to the vertical axis to a bottom end that is connected to the lower helical section, and the lower helical section may extend from a top end that is connected to the lower end of the upper helical section to a bottom end of the lower helical section that is fixed relative to the vertical axis. Extension and retraction of the second cylinder relative to the first cylinder may cause a connection point between the upper helical section and the lower helical section to move about the vertical axis in the first circumferential direction and the second circumferential direction, respectively.

Various other features, objects, and advantages will be made apparent from the following description taken together with the drawings.

BRIEF DESCRIPTION OF THE DRAWINGS

The present disclosure is described with reference to the following drawings.

DETAILED DISCLOSURE

Figure 1:
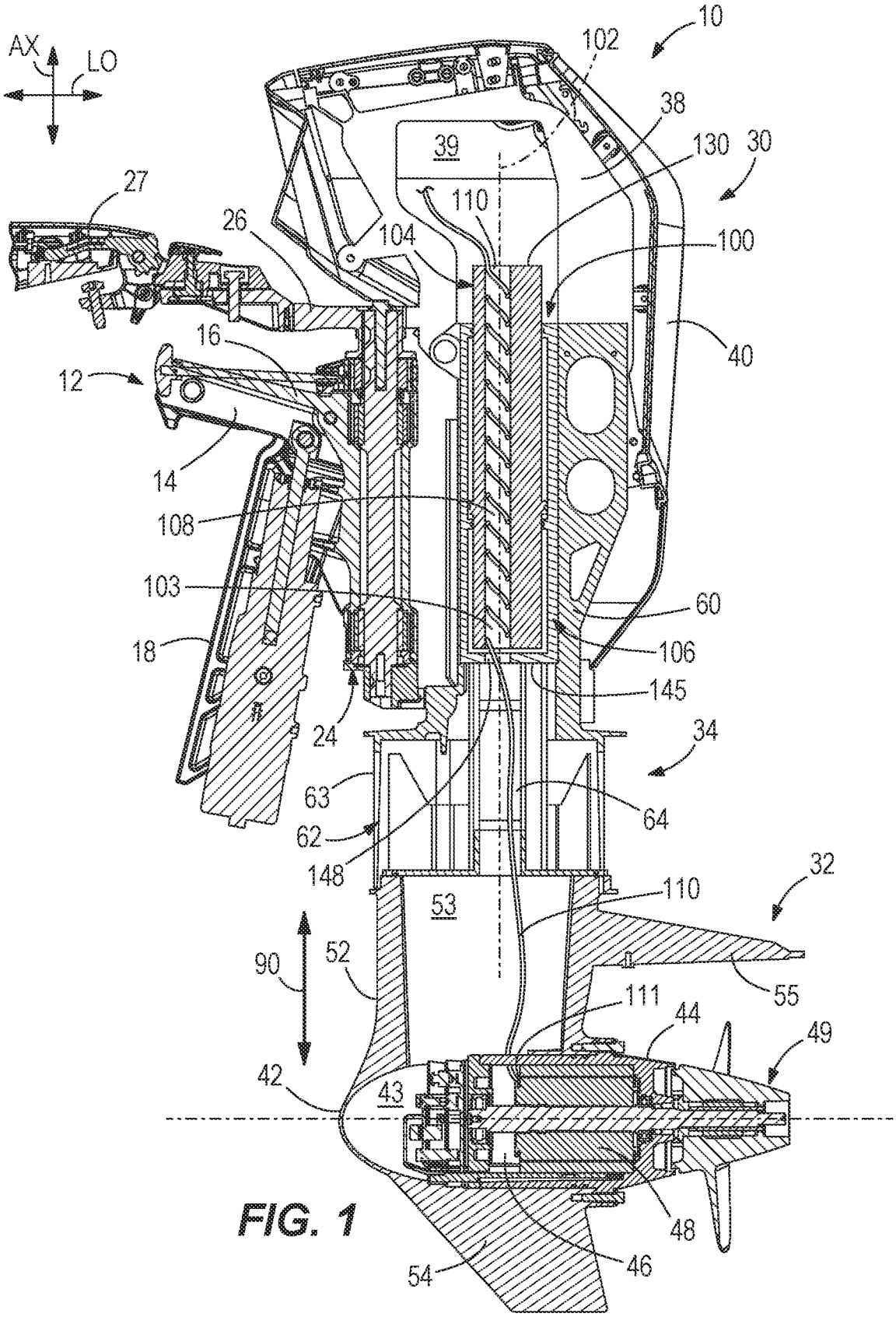
FIG. 1 is a cross-sectional view of an embodiment of a marine drive including an adjustable midsection.

FIG. 1 depicts a marine drive 10 for propelling a marine vessel (not shown) in a body of water. In the illustrated embodiment, the marine drive 10 is extends from top to bottom in an axial direction AX, from front to back in a longitudinal direction LO which is perpendicular to the axial direction AX, and from side to opposite side in a lateral direction LA which is perpendicular to the axial direction AX and perpendicular to the longitudinal direction LO (see, e.g., FIGS. 6 and 7).

Referring to FIG. 1, the illustrated marine drive 10 is configured as an outboard motor having an upper unit 30, a lower unit 32, and a midsection 34 that suspends the lower unit 32 from the upper unit 30. As discussed in further detail below, the illustrated midsection 34 is configured as an adjustable midsection 34 that may be extended and retracted to adjust the length of the midsection 34, thereby vertically moving the lower unit 32 away from and towards the upper unit 30, respectively.

The illustrated marine drive 10 is attachable to the marine vessel via a transom bracket assembly 12 configured to support the marine drive on a transom (not shown) of the marine vessel. The transom bracket assembly 12 includes a transom bracket 14 configured to be fixed to the transom and a swivel bracket 16 pivotably coupled to the transom bracket 14. The transom bracket 14 has a pair of C-shaped arms 18 which are configured to fit over the top of the transom. The swivel bracket 16 is pivotable with respect to the C-shaped arms 18 about a trim shaft that laterally extends through the forward upper ends of the C-shaped arms 18, thereby defining a trim axis that is generally parallel to the lateral axis LA. Pivoting of the swivel bracket 16 about the trim axis trims the marine drive 10 relative to the marine vessel, for example out of and/or back into the body of water in which the marine vessel is operated.

The marine drive 10 is movably connected to the transom bracket assembly 12 by a swivel assembly 24 that defines a steering axis about which the marine drive 10 may pivot relative to the transom bracket assembly 12. A top end of swivel assembly 24 is connected to a steering arm 26 which extends from a supporting frame 38 of the upper unit 30 such that the marine drive 10 and the steering arm 26 are pivotable together about the steering axis. A tiller arm 27 (partially shown in FIG. 1) is connected to the forward end of the steering arm 84 and may be used to steer the marine drive 10 with respect to the marine vessel. Additionally or alternatively, some embodiments of a marine drive 10 may be configured with any other suitable apparatus and/or system for supporting a marine drive relative to a marine vessel and steering the marine drive with respect to a marine vessel.

With continued reference to FIG. 1, the upper unit 30 includes a supporting frame 38 for rigidly supporting the various components of the marine drive 10 on the transom bracket assembly 12. The supporting frame 38 has a frame body which defines an interior cavity 39 configured to house at least one internal component of the marine drive 10 supported by the supporting frame 38. A cowling 40 is supported on the supporting frame 38 and encloses the interior cavity 39.

The lower unit 32 is coupled to and suspended from the upper unit 30 by a novel extension joint 100 that is at least partially located within the midsection 34, as discussed in further detail below. The lower unit 32 is positioned at a bottom end of the midsection 34 and includes a torpedo housing 42 with a front housing portion 43 and a rear housing portion 44 that are mated together and define a motor cavity 46, which contains a propulsor 48 configured to rotate a propeller 49 positioned at the rear end of the torpedo housing 42, as well as any other related componentry. In the illustrated embodiments, the propulsor 48 is an electric motor 48 powered by a power source (e.g., batteries) that may be secured to the upper unit 30 and/or positioned at a location remote from the marine drive 10, such as in the marine vessel. The front housing portion 43 has a nosecone with a smooth outer surface which transitions to an upwardly extending stem 52 and a downwardly extending skeg 54. The stem 52 extends upwards from the torpedo housing 42 to the bottom end of the midsection 34 and includes a rearwardly extending anti-ventilation plate 55.

With continued reference to FIG. 1, the midsection 34 includes a midsection body 62 that is coupled to a top end of the stem 52, thereby supporting the lower unit 32, and an extension leg 60 that extends upwardly from the midsection body 62 and into the interior of the cowling 40 of the upper unit 30. The extension leg 60 is coupled to and receives a lower portion (i.e., a lower cylinder 106) of the novel extension joint 100 such that the midsection 34 and the lower unit 32 are suspended therefrom. A conduit 64 extends vertically between the extension joint 100 and an interior passage 53 in the stem 52 of the lower unit 32 and provides an at least partially scaled passageway for an electrical connector 110 and/or another a wire, cable, and/or other connector may extend from the upper unit 30, through the extension joint 100, and into the torpedo housing 22 via the conduit 64 and the interior passage 53 of the stem 52. The interior passage 53 through the stem 52 is generally aligned with extension joint 100. Thus, connectors may extend through the extension leg 60 and the midsection body 62 from the upper unit 30 to the lower unit 32. This may be useful, for example, to provide power and/or control signals from a battery, controller, or other component in the upper unit 30 or on the marine vessel to the torpedo housing 42, for example, to provide electricity to the motor 48 and/or for controlling the motor 48.

Referring to FIG. 1, embodiments of a marine drive 10 may be configured with an extension joint 100 that suspends the lower unit 32 from the upper unit 30 such that that the lower unit 32 is movable towards and away from the upper unit 30. At least one electrical connector 110 extends from the upper unit 30 to the lower unit 32 via the extension joint 100. The electrical connector 110 has a first end 111 coupled to the motor 48 and a second end coupled to a source of electricity (e.g., a battery), which may be in the upper unit 30 and/or another location on the marine drive 10 and/or the marine vessel. It should be noted that the embodiment of FIG. 1 is illustrated with an electrical connector 110 including a single cable. However, as illustrated in FIG. 2, some embodiments may be configured with an electrical connector 110 that includes multiple cables 112, 114, wires, and/or other connectors.

Figure 2:
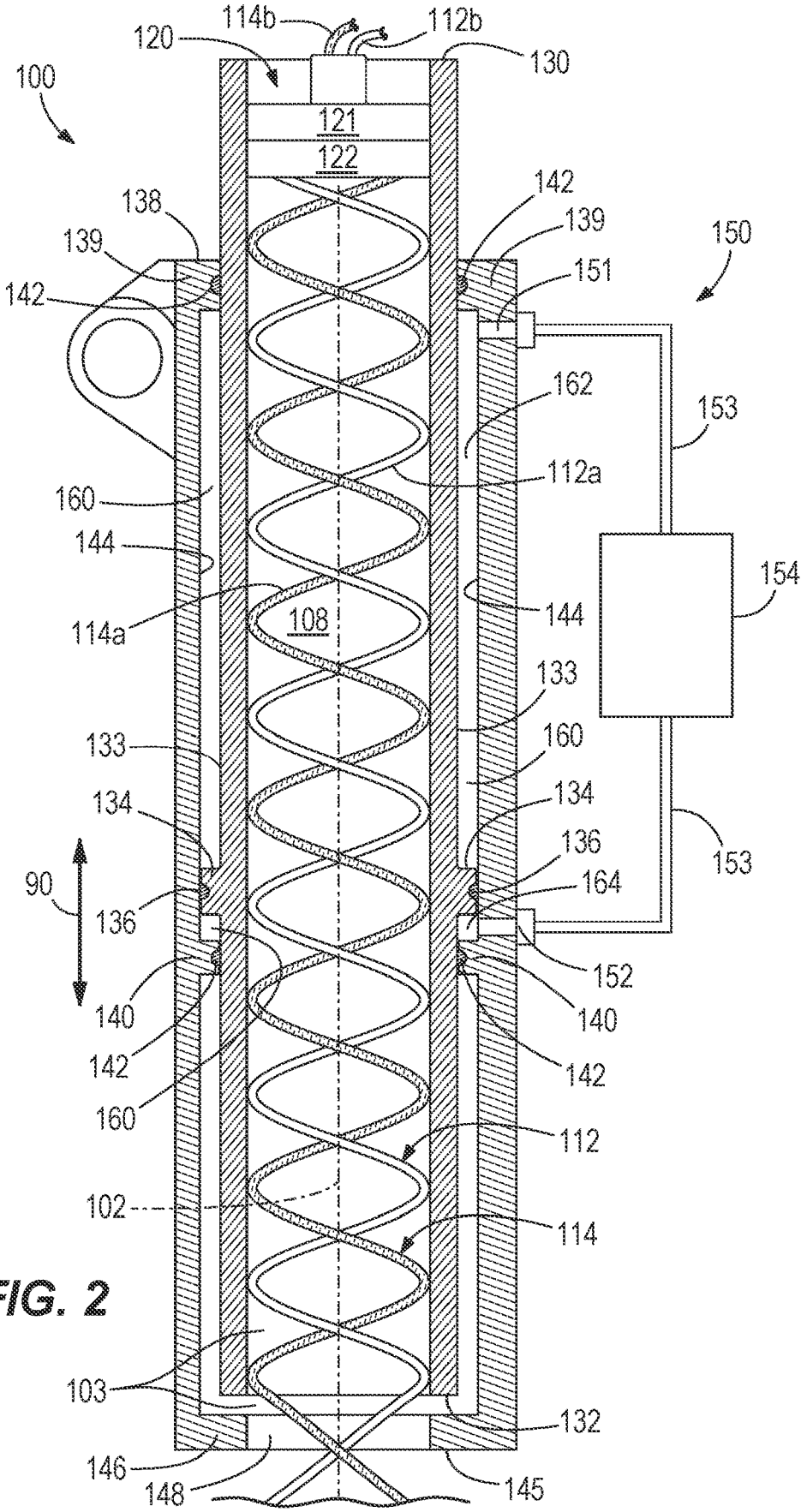
FIG. 2 is a cross-sectional view of an embodiment of an extension joint for a marine drive with an adjustable midsection.

Referring to FIG. 2, the illustrated extension joint 100 is configured as a telescoping joint that can be extended and retracted to adjust a length of the extension joint 100. The extension joint 100 includes a first cylinder 104 and a second cylinder 106 that, together, form a sealed cylindrical cavity 103 that defines a vertical axis 102 and through which an electrical connector 110 extends. The first cylinder 104 is fixedly coupled to the supporting frame 38 of the upper unit 30, and the second cylinder 106 is fixedly coupled to the lower unit 32 via the extension leg 60 of the midsection 34. The first cylinder 104 includes a body that extends vertically between a top end 130 in the upper unit 30 and a bottom end 132 that is received within a body of the second cylinder 106.

The body of the second cylinder 106 extends between a top end 138 and a bottom end 145. The second cylinder 106 includes an upper flange 139 positioned proximate a top end 138 of the second cylinder 106 and an interior flange 140 that projects inward from a radially inner surface 144 of the second cylinder 106 to a radially outer surface 133 of the first cylinder 104. A sliding seal 142 forms a seal between the upper and interior flanges 139, 140 and the radially outer surface 133 of the first cylinder 104, thereby defining an annular chamber 160 between the second cylinder 106 and the first cylinder 104. An annular lip 134 projects outward from the radially outer surface 133 of the first cylinder 104 towards the radially inner surface 144 of the second cylinder 106. A sliding seal 136 forms a seal between the first and second cylinders 104, 106, thereby dividing the annular chamber 160 into a top section 162 and a bottom section 164 that is sealed off from the top section 162 by the sliding seal 136 and the annular lip 134. The top section 162 is defined between the upper flange 139 of the first cylinder 104 and the annular lip 134, and the bottom section 164 is defined between the annular lip 134 and the interior flange 140.

With continued reference to FIG. 2, at the bottom end 145 of the second cylinder 106, an opening 148 into the sealed cavity 103 is defined by a lower flange 146 that extends radially inward from the peripheral wall of the second cylinder 106. In some embodiments, a seal member (not shown) may be positioned in the opening 148 to seal the bottom end 145 of the second cylinder 106 while allowing an electrical connector 110 to extend out through the opening 148. Similarly, the top end 130 of the first cylinder 104 may include a seal member (not shown) configured to seal the top end 130 of the first cylinder 104 while allowing an electrical connector 110 to extend out of the top end 130. Thus, the first cylinder 104 and the second cylinder 106 together define a sealed cavity 103 that extends between the top end 130 of the first cylinder 104 and the bottom end 145 of the second cylinder 106. As the extension joint 100 is extended and retracted, the sealed cavity 103 is also extended and retracted.

As previously mentioned, the extension joint 100 is a telescoping joint that may be extended and retracted by sliding the second cylinder 106 on the first cylinder, for example in the direction of arrow 90. In some embodiments, a marine drive 10 may be configured with an actuator system 150 (shown schematically) configured to move the second cylinder 106 relative to the first cylinder 104. With continued reference to FIG. 2, the actuator system 150 includes a hydraulic pump 154 that is configured to pump a hydraulic fluid into an annulus (i.e., the annular chamber 160) between the first and second cylinders 104, 106 so as to move the second cylinder 106 relative to the first cylinder 104. In the illustrated embodiments, the hydraulic pump 154 is connected to the top section 162 of the annular chamber 160 via a hydraulic line 153 and an upper port 151 formed through the side wall of the second cylinder 106, and to the bottom section 164 of the annular chamber 160 via a hydraulic line 153 and a lower port 152 formed through the side wall of the second cylinder 106.

With continued reference to FIG. 2, to extend the extension joint 100 and lower the lower unit 32, the hydraulic pump 154 can be controlled to pump the hydraulic fluid into the bottom section 164 of the annular chamber 160 to increase the pressure therein. As the pressure increases in the bottom section 164, the second cylinder 106 is forced to slide downwards on the first cylinder 104, thereby extending the extension joint 100 and lowering the lower unit 32. To raise the lower unit 32, the hydraulic pump 154 can be controlled to pump the hydraulic fluid into the top section 162 of the annular chamber 160 to increase the pressure therein. As the pressure increases in the top section 162, the second cylinder 106 is forced to slide upwards on the first cylinder 104, thereby retracting the extension joint 100 and lifting the lower unit 32 up towards the upper unit 30. Thus, the second cylinder 106 can telescope relative to the first cylinder 104 along the vertical axis 102 to move the lower unit 32 towards and away from the upper unit 30, thereby raising and lowering the lower unit 32.

In some embodiments, the extension joint 100 may be configured with a stop member to limit the range of motion of the second cylinder 106 relative to the first cylinder 104. As illustrated in FIG. 2, for example, the upper flange 139 and interior flange 140 of the second cylinder 106 act as stops that abut the annular lip 134 of the first cylinder 104 to respectively define a fully retracted position and a fully extended position of the extension joint 100. Additionally or alternatively, the lower flange 146 of the second cylinder 106 may be configured as a stop that abuts the bottom end 132 of the first cylinder 104. Some embodiments, may be configured with a different arrangement for limiting the range of motion of the second cylinder 106 relative to the first cylinder 104.

As previously mentioned, the extension joint 100 includes an electrical connector 110 that extends through the sealed cavity 103 of the extension joint 100 to electrically connect the electric motor 48 to a power source. As illustrated in FIG. 1, for example, the electrical connector 110 extends into the extension joint 100 and the sealed cavity 103 via the opening at the top end 130 of the first cylinder 104, downward through the sealed cavity 103 (and therefore through the internal passage 108 in the first cylinder 104), and out of the sealed cavity 103 via the opening 148 at the bottom end 145 of the second cylinder 106. The electrical connector 110 continues downward through the conduit 64 in the midsection 34 and the interior passage 53 in the stem 52 to reach the electric motor 48 in the torpedo housing 42.

Referring to FIG. 2, the electrical connector 110 includes two connector cables 112, 114 extending through the extension joint 100. At least one of the connector cables 112, 114 may be configured as an over-molded wire. Each connector cable 112, 114 has a helical section 112*a*, 114*a* with a helical shape which spirals around the vertical axis 102 between a first end at the bottom of the sealed cavity 103 and a second end at the top of the sealed cavity 103. The helical sections 112*a*, 114*a* of the first connector cable 112 and the second connector cable 114 are intertwined and circumferentially offset from each other such that the electrical connector 110 has a double helical shape. The helical shape of the connector cables 112, 114 allows the electrical connector 110 to extend and retract to maintain the connection between the propulsor 48 (i.e., the electric motor 48) and the power source as the extension joint 100 is extended and retracted. As such, the helical shape of the connector cables 112, 114

(and the double helical shape of the electrical connector 110 as a whole) are compressed and extended when the lower unit 32 is moved towards and away from the upper unit 30, respectively.

As the helical shape of the connector cables 112, 114 is extended and compressed, the vertical distance between the first and second ends of the connector cables 112, 114 increases and decreases, respectively, while the length of each connector cable 112, 114 between their first and second ends remains unchanged. Thus, when the electrical connector 110 is compressed or retracted, the diameter of the helical shapes respectively increases and decreases in order to accommodate the unchanged length of the connector cables 112, 114 between a changing vertical dimension thereof. As the connector cables 112, 114 are compressed and/or retracted, the first end and/or the second end of the connector cables 112, 114 pivot about the vertical axis 102 in order to accommodate the changing diameters of their helical shapes without introducing bends or kinks into either of the connector cables 112, 114.

In order to facilitate the compression and extension of the connector cables 112, 114 of the electrical connector 110, the extension joint 100 is configured with a slip ring 120 through which the electrical connector 110 extends. Referring to FIG. 2, the slip ring 120 includes a stationary part 121 and a rotatable part 122 that is rotatable relative to the stationary part 121 about the vertical axis 102 defined by the extension joint 100. In the illustrated embodiment, the rotatable part 122 and the stationary part are both positioned in the internal passage 108 through the first cylinder 104, and the stationary part 121 is fixed relative to the first cylinder 104 while the rotatable part 122 can freely rotate relative to the first cylinder 104. Thus, the slip ring 120 may form a seal in the interior passage 108, thereby sealing the top end 130 of the first cylinder 104 Some embodiments, however, may be differently configured. For example, the rotatable part 122 may be at least partially disposed within the sealed cavity 103 while at least a portion of the stationary part 121 is positioned outside sealed cavity 103.

Figure 3:
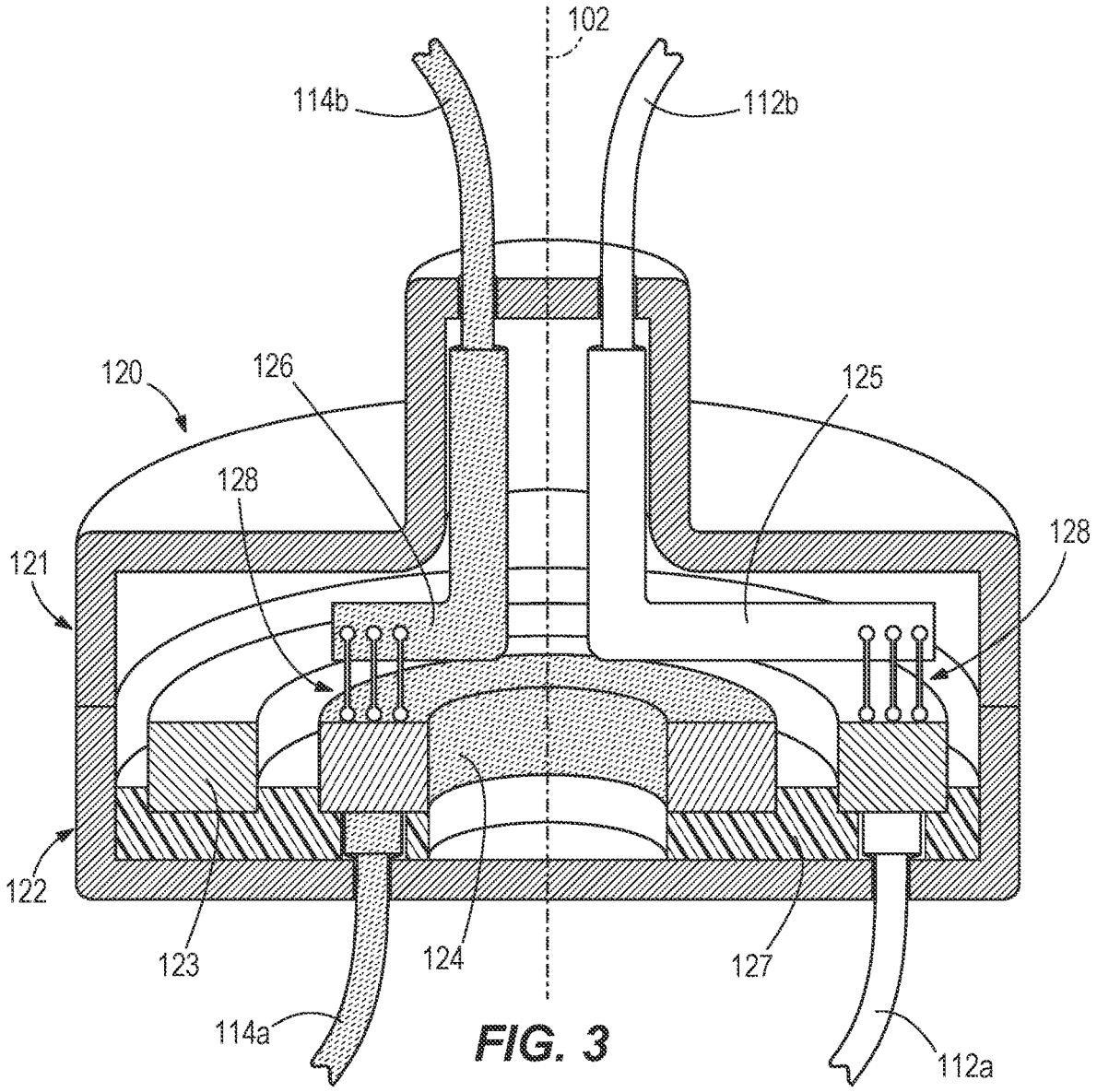
FIG. 3 is a cross-sectional view of the slip ring of the extension joint of FIG. 2.

Referring to FIG. 3, the slip ring 120 is configured to permit rotation of a first portion 112*a*, 114*a* of each connector cable 112, 114 relative to a second portion 112*b*, 114*b* of the connector cables 112, 114, thereby facilitating compression and extension of the helical sections 112*a*, 114*a* of the connector cables 112, 114 and the electrical connector 110 as a whole. The first portion 112*a*, 114*a* of each connector cable 112, 114 extends upward through the sealed cavity 103 and is connected a corresponding annular contactor 123, 124 positioned in the rotatable part 122 of the slip ring 120. In the illustrated embodiments, the annular contactors 123, 124 are mounted on an insulating material 127. Some embodiments, however, may omit the insulating material 127. The second portions 112*b*, 114*b* of the connector cables 112, 114 are each connected to a corresponding point contactor 125, 126 in the stationary part 121 extend out from the stationary part 121 to ends (not shown) that are connected to the power source. As the first portions 112*a*. 114*a* of the connector cables 112, 114 are compressed or extended, the changing dimension(s) of the helical sections 112*a*, 114*a* of the connector cables 112, 114 forces the rotatable part 122 of the slip ring 120 to rotate about the vertical axis 102. As the rotatable part 122 rotates, an electrical connection 128 between the point contactors 125, 126 and the corresponding annular connector 123, 124 is maintained, for example by a brush connection 128, thereby maintaining the electrical connection between the power source and the electric motor 48.

Thus, the novel extension joint 100 provides an adjustable connection between the upper unit 30 and the lower unit 32 to accommodates a helical electrical connector 110 that extends and retracts as the lower unit 32 is raised and lowered relative to the upper unit 30. Advantageously, the double helical shape of the electrical connector 110 reduces the wear experienced by the connector cables 112, 114, for example by limiting how much the connector cables 112, 114 rub against the interior surfaces of the sealed cavity 103 as the second cylinder 106 is raised and lowered relative to the first cylinder 104. Additionally, the helical shape of the connector cables 112, 114, in conjunction with the slip ring 120, allows the connector cables 112, 114 to be compressed without bending or creating kinks, which also reduces the wear on the electrical connector 110.

Figure 4:
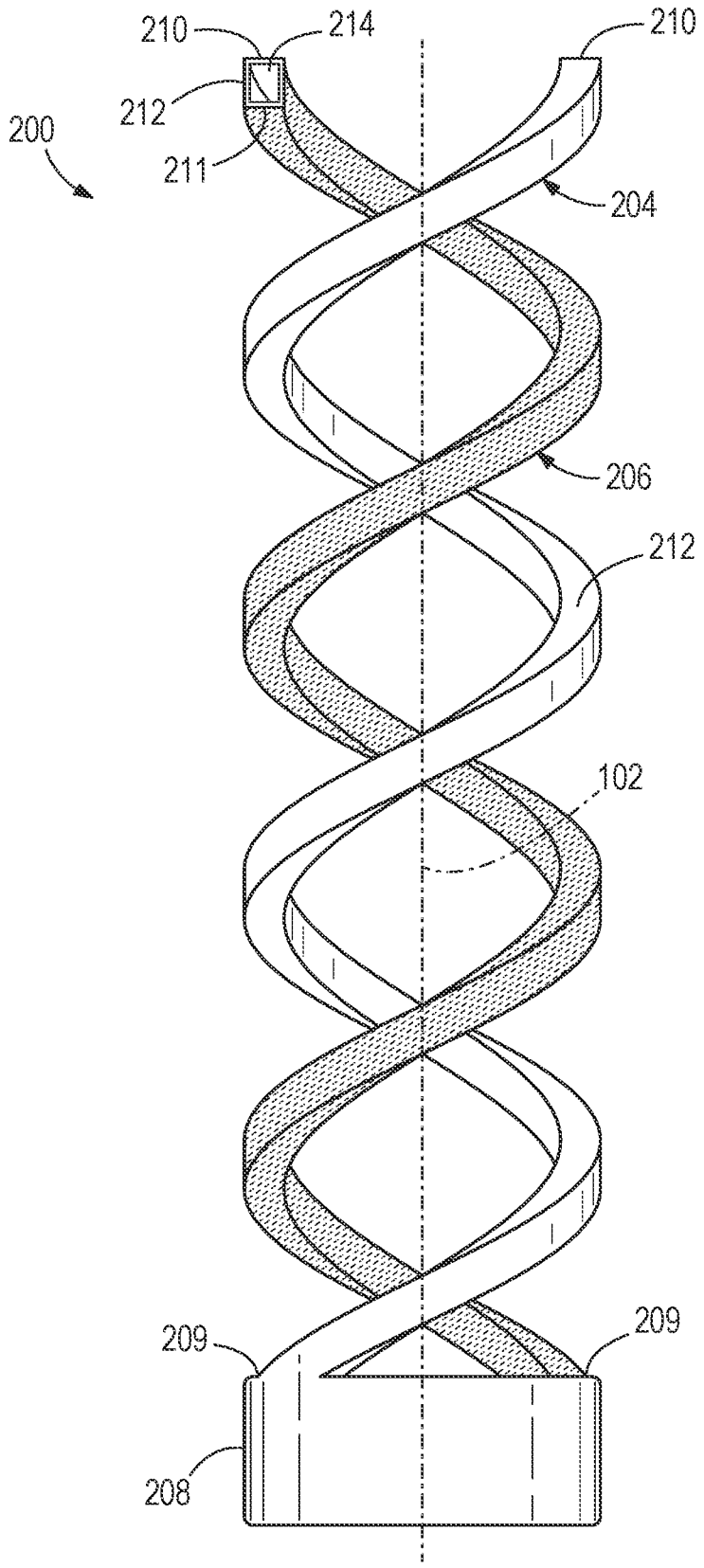
FIG. 4 is a side view of an embodiment of a protective sheath for the extension joint of a marine drive with an adjustable midsection.

In some embodiments, an extension joint 100 for a marine drive 10 with an adjustable midsection 34 may be configured with a protective sheath that contains the electrical connector 110 in the extension joint 100 and reduces frictional abrasion of the electrical connector 110 during movement of the lower unit 32 relative to the upper unit 30. For example, FIG. 4 illustrates an embodiment of a protective sheath 200 configured to be received in the sealed cavity 103. The protective sheath 200 encloses and protects the connector cables 112, 114 of an electrical connector 110, such as those of FIG. 3. The protective sheath 200 includes two protective sleeves 204, 206 that each extend vertically between a base 208 and a top end 210 of the protective sheath 200. Each of the protective sleeves 204, 206 has a helical shape which spirals around the vertical axis 102 when the protective sheath 200 is positioned in the extension joint 100. Together, the first and second protective sleeves 204, 206 form a double helical shape that corresponds to (and encloses) the double helical shape of the electrical connector 110. The first and second protective sleeves 204, 206 each have a peripheral wall 212 that encloses a passageway 214 extending through the helical protective sleeves 204, 206. The protective sleeves 204, 206 extend between a hollow interior space (not shown) in the base 208 and an opening 211 at the top end 210 of the protective sheath 200. The helical section 112*a* of the first connector cable 112 and the helical section 114*a* of the second connector cable 114 respectively extend through the first protective sleeve 204 and the second protective sleeve 206.

In the illustrated embodiments, the protective sheath 200 is configured to be positioned in the extension joint 100 with the base 208 positioned proximate the bottom of the sealed cavity 103 and the top end 210 and openings 211 into the sleeves 204, 206 positioned proximate the slip ring 120 (FIG. 2). For example, some embodiments of an extension joint 100 may be configured to receive the base 208 of the protective sheath 200 in the opening 148 at the bottom end 145 of the second cylinder 106. This may be useful, for example, in order to seal the scaled cavity 103, and so that the protective sheath 200 extends between the top and bottom ends of the sealed cavity 103. In some embodiments, at least one of the protective sleeves 204, 206 may be coupled to the rotatable part 122 of the slip ring 120. For example, the opening 211 of a sleeve 204, 206 which is connected to the rotatable part 122 of the slip ring 120 may open into the interior of the slip ring 120. This may be useful, for example, in order to seal the protective sleeve 204, 206 against the slip ring 120. In some embodiments, the protective sheath 200 may be configured with a base 208 located at the top end of the sheath 200 and protective sleeves 204, 206 that extend downwardly from the base 208. Additionally or alternatively, a protective sheath 200 may be configured to receive at least a portion of a slip ring 120 within the interior cavity within the base 208.

To protect the connector cables 112, 114 of the electrical connector 110, the first and second protective sleeves 204, 206 are configured to be extended and compressed upon extension and retraction, respectively, of the second cylinder 106 relative to the first cylinder 104. To facilitate the extension and compression of the protective sleeves 204, 206, at least a portion of the protective sleeves 204, 206 may be formed from a deformable and abrasion resistant material. For example, at least one of the protective sleeves 204, 206 may be formed from an elastically deformable material so that the protective sleeves 204, 206 can be repeatedly extended and compressed without incurring wear. Additionally or alternatively, at least one of the protective sleeves 204, 206 may be formed from a resiliently deformable material so that the protective sleeve(s) 204, 206 are biased to return to a resting configuration.

As the second cylinder 106 is extended and retracted relative to the first cylinder 106, the helical shapes of the protective sleeves 204, 206 and the connector cables 112, 114 enclosed in the protective sleeves 204, 206 are extended and compressed together. The protective sleeves 204, 206 separate the connector cables 112, 114 from the interior surfaces of the sealed cavity 103 to prevent rubbing motion and abrasive contact between the connector cables 112, 114 and the interior surfaces of the sealed cavity 103. Because the shape and dimensions of the protective sleeves 204, 206 generally match the shape and dimensions of the connector cables 112, 114, the connector cables 112, 114 move with the protective sleeves 204, 206 during compression and extension of the protective sheath 200, thereby minimizing the wear due to rubbing/abrasion between the connector cables 112, 114 and the interior surfaces of the passageway 214 through the protective sleeves 204, 206. Thus, protective sheath 200 advantageously reduces the frictional abrasion of the electrical connector 110 during movement of the lower unit 32 relative to the upper unit 30.

Figure 5:
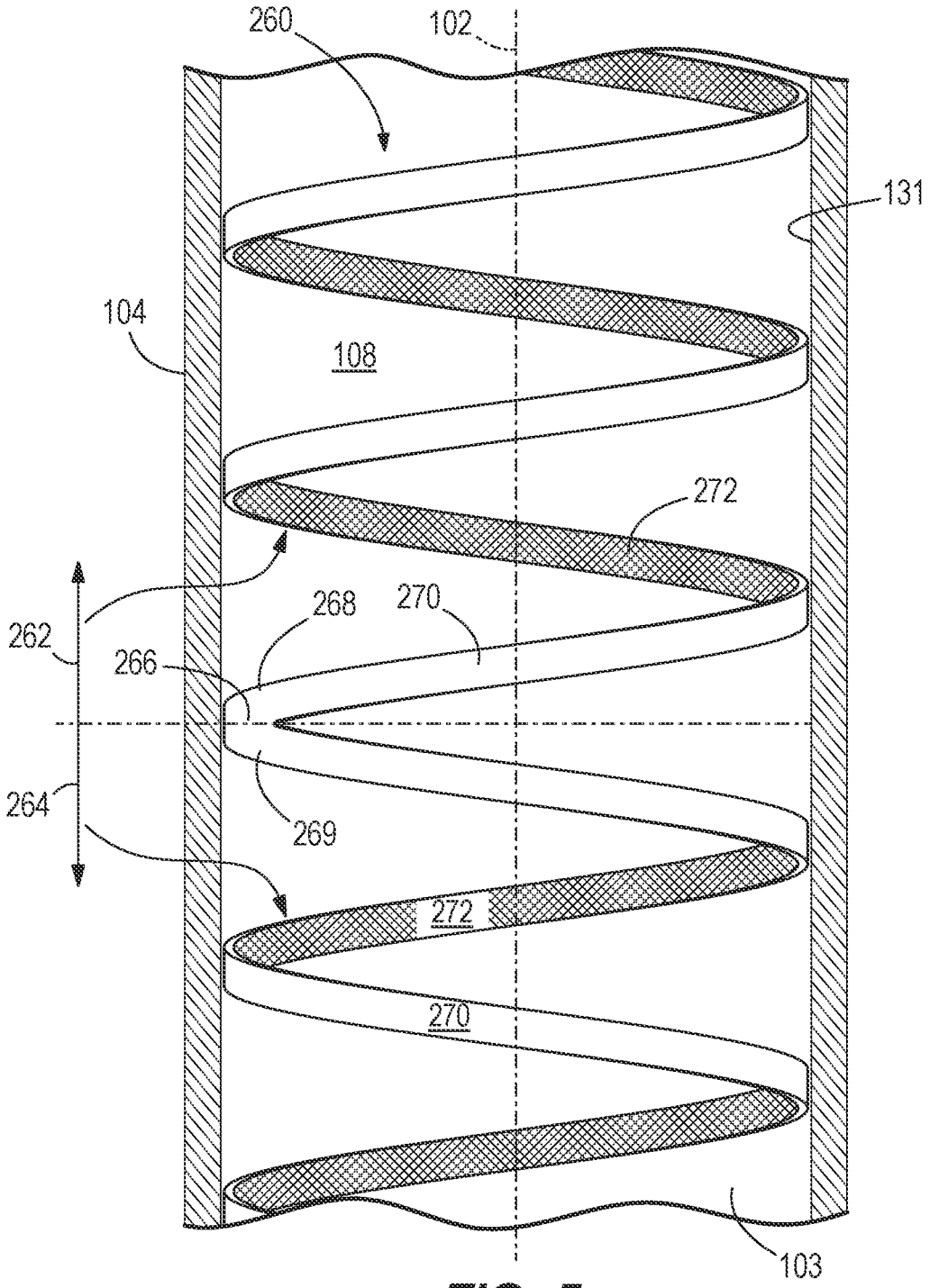
FIG. 5 is a partial cross-sectional view of another embodiment of a protective sheath for an extension joint.

In the embodiment of FIG. 4, the protective sheath 200 is configured to be used with a slip ring 120 so that the ends 210 of the protective sleeves 204, 206 can rotate about the vertical axis 102 relative to the base 208 during compression and expansion of the sleeves 204, 206. Some embodiments, however, may be differently configured. For example, FIG. 5 illustrates an embodiment of a protective sleeve 260 for a protective sheath configured with top and bottom ends (not shown) of the protective sleeve 260 that are in fixed positions relative to the vertical axis 102. The illustrated protective sleeve 260 is configured to enclose and protect a connector cable extending therethrough, and to facilitate the compression and extension of the protective sleeve 260. In FIG. 5, a single protective sleeve 206 is depicted within the internal passage 108 of the first cylinder 104. However, it should be appreciated that embodiments a protective sheath may include two protective sleeves 260 that are intertwined to form a double helical shape.

Referring to FIG. 5, the protective sleeve 260 includes an upper helical section 262 and a lower helical section 264. The upper helical section 262 extends vertically between a top end (not shown) positioned proximate the top of the extension joint 100 and a bottom end 268 at a connection point 266 between the upper helical section 262 and the lower helical section 264. The lower helical section 264 extends vertically between a top end 269 at the connection point 266 and a bottom end (not shown) positioned proximate the bottom of the extension joint 100. Similar to the protective sleeves 204, 206 of FIG. 4, the protective sleeve 260 includes an interior passageway (not shown) that extends through the sleeve 260 between the top and bottom ends of the sleeve 260. Thus, an connector cable, for example a connector cable 112, 114 of FIG. 2, can extend through the sealed cavity 103 of the extension joint 100 (FIG. 3) inside the passageway in the sleeve 260.

With continued reference to FIG. 5, the upper helical section 262 is formed about the vertical axis 102 defined by the cylindrical cavity 103 (FIG. 2). The helical shape of the upper helical section 262 extends in a first circumferential direction about the vertical axis, which is the clockwise direction from the top end to the bottom end 268 in the illustrated embodiment. The lower helical section is 264 formed about the vertical axis 102 and extends in a second circumferential direction opposite the first circumferential direction, which is the counterclockwise direction from the top end 269 to the bottom end. Thus, the upper and lower helical sections 262, 264 meet at a connection point 266 where the direction of the protective sleeve 260 reverses. In FIG. 5, a radially inner surface 272 of the protective sleeve 260 is depicted with shading to differentiate the radially inner surface 272 from a radially outer surface 270 of the sleeve 260.

To facilitate the compression and extension of the protective sleeve 260, the connection point 266 between the upper helical section 262 and the lower helical section 264 is configured to move circumferentially about the vertical axis 102 when the second cylinder 106 is extended or retracted relative to the first cylinder 104. When the second cylinder 106 is retracted, the compression of the protective sleeve 260 causes the connection point 266 to move circumferentially about the vertical axis 102 in the first circumferential direction. When the second cylinder 106 is extended, the extension of the protective sleeve 260 causes the connection point 266 to move circumferentially about the vertical axis 102 in the second circumferential direction. Advantageously, circumferential movement of the protective sleeve 260 at the connection point 266 allows the helical shape of the sleeve 260 to accommodate the compression and extension thereof with top and bottom ends of the sleeve 260 that are fixed relative to the vertical axis 102. Similar to the protective sleeves 204, 206 of FIG. 4, the protective sleeve 260 of FIG. 5 separates an connector cable extending through the sleeve 260 from the interior surfaces of the sealed cavity 103 to prevent rubbing motion and abrasive contact therebetween. An connector cable extending through the protective sleeve 260 generally moves with the sleeve 260 during compression and extension of the protective sheath, thereby minimizing the wear due to rubbing/abrasion between the connector cable and the interior surfaces of the sleeve 260. Thus, protective sleeve 260 advantageously reduces the frictional abrasion of an electrical connector during movement of the lower unit 32 relative to the upper unit 30.

In some embodiments, a marine drive 10 including an adjustable midsection 34 may be configured with a locking mechanism configured to selectively retain the lower unit 32 in a desired position relative to the upper unit 30. For Example, FIG. 6 illustrates an embodiment of a marine drive 10 with a locking mechanism 300 that is movable into and between a locked position in which vertical movement of the lower unit 32 relative to the upper unit 30 is restricted and an unlocked position (FIG. 6) in which vertical movement of the lower unit 32 relative to the upper unit 30 is permitted.

Figure 6:
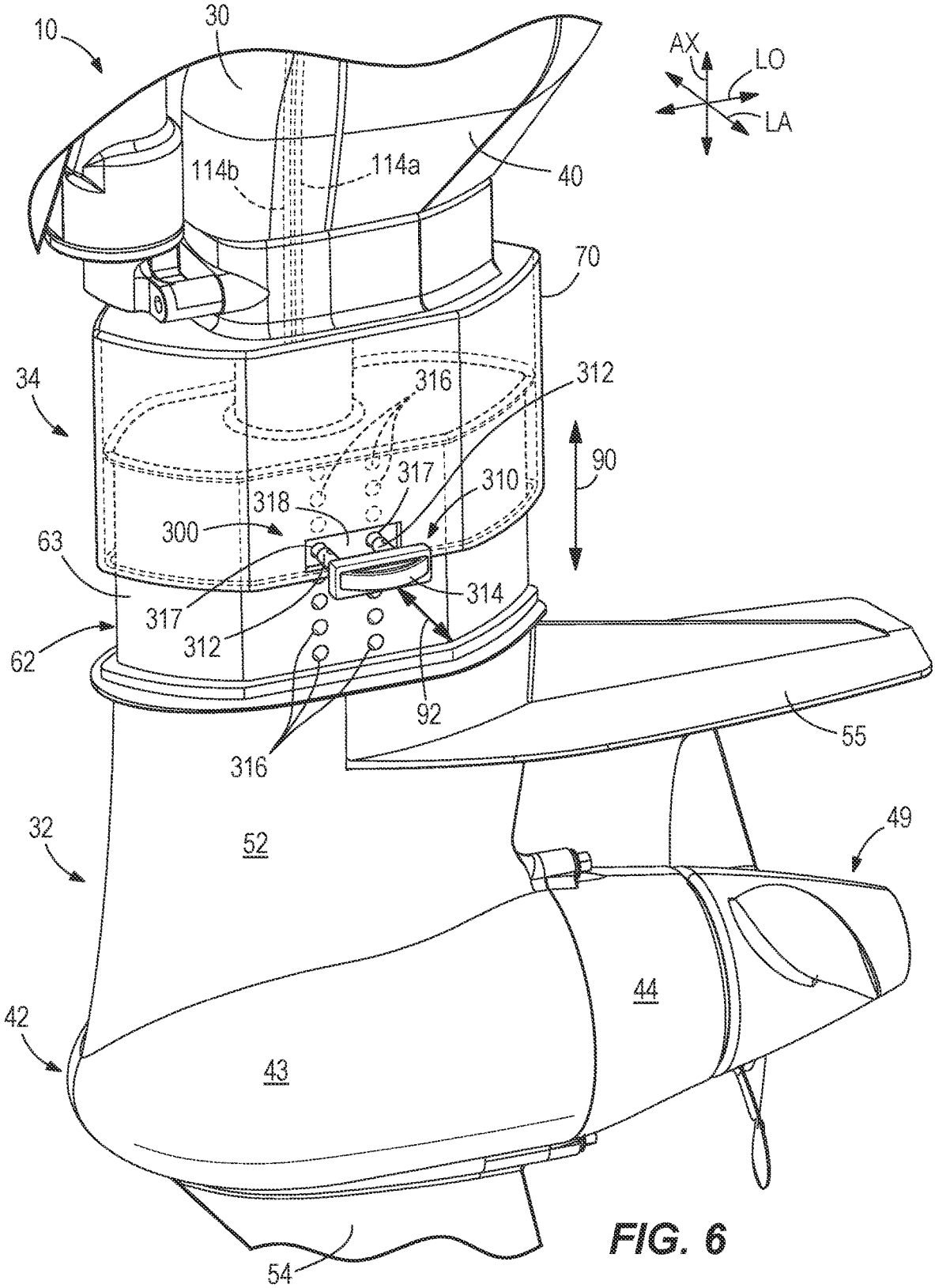
FIG. 6 is a perspective view of an embodiment of a marine drive that includes an adjustable midsection and a locking mechanism for the adjustable midsection.

Referring to FIG. 6, the locking mechanism 300 includes a lock member 310 a plurality of openings 316 formed through a side wall 63 of the body 62 of the midsection 34.

The lock member 310 includes a handle 314 and two pins 312 that extend from the handle 314 and through openings 317 formed through a shroud 70 extending downwardly from the bottom end of the upper unit 30. The pins 312 are slidable received in the openings 317 such that the lock member 310 can slide into and between an unlocked position in which the pins 312 are disengaged from the openings 316 formed through in the midsection body 62 and a locked position in which the pins 312 are engaged from the openings 316 formed through in the midsection body 62, for example in the direction of arrow 92.

In the unlocked position illustrated in FIG. 6, the lower unit 32 and the second cylinder 106 are extendable and retractable relative to the upper unit 30 and the first cylinder 104, for example in the direction of arrow 90. To lock the locking mechanism 300, the lock member 310 is pushed inward to engage the pins 312 with the openings 316 in the midsection body 62. In the locked position, the lower unit 32 and the second cylinder 106 are fixed relative to the upper unit 30 and the first cylinder 104, thereby retaining the lower unit 32 in a desired position. In the illustrated embodiment, a recess 318 formed in the outer surface of the shroud 70 is configured to receive a portion of the handle 314 when the lock member 310 is in the locked position. Some embodiments, however, may omit the recess 318.

Figure 7:
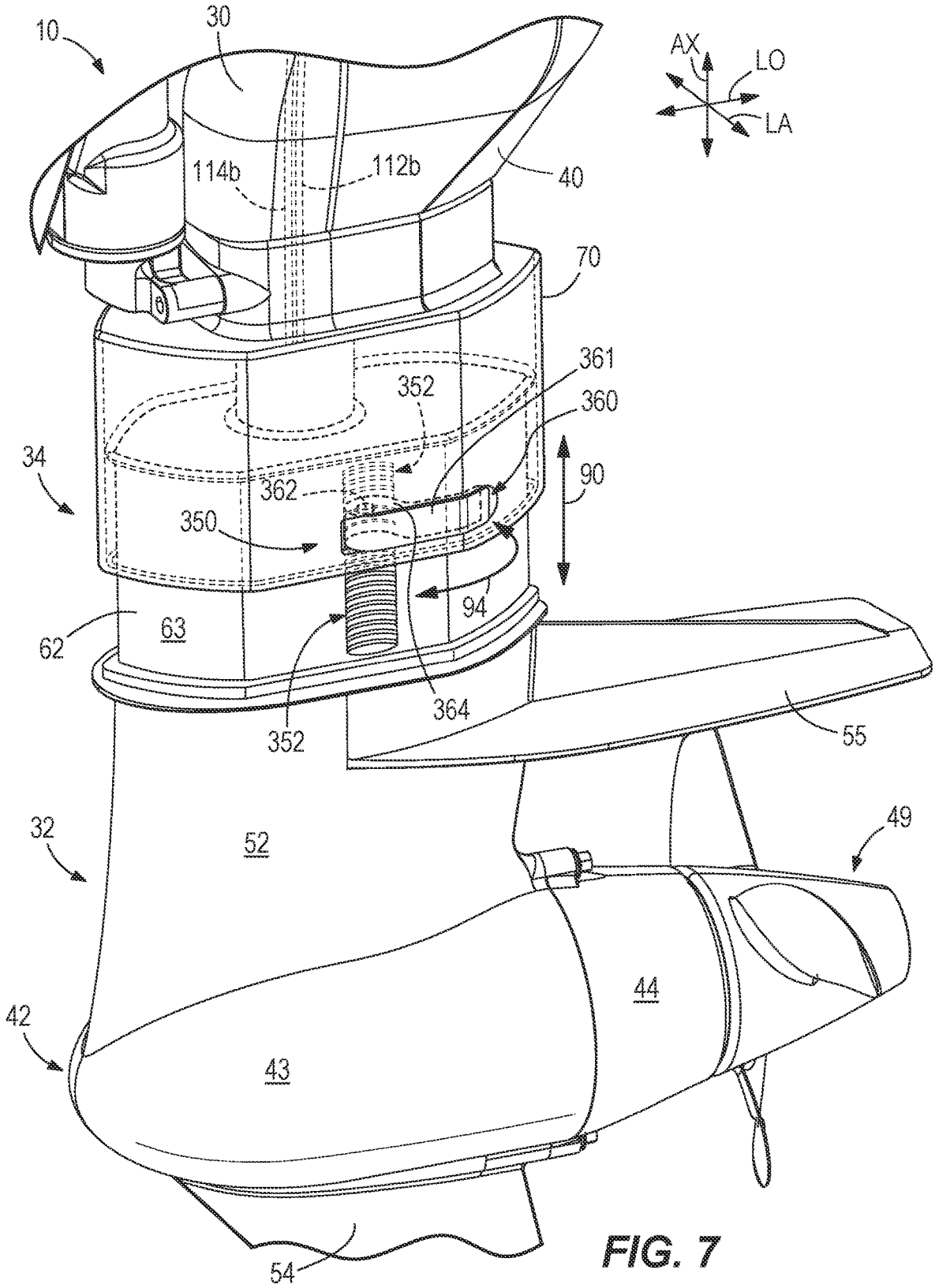
FIG. 7 is a perspective view of another embodiment of a marine drive that includes an adjustable midsection and a locking mechanism for the adjustable midsection.

FIG. 7 illustrates another embodiment of a locking mechanism 350 that is movable into and between a locked position (FIG. 7) in which vertical movement of the lower unit 32 relative to the upper unit 30 is restricted and an unlocked position in which vertical movement of the lower unit 32 relative to the upper unit 30 is permitted. The locking mechanism 350 of FIG. 7 includes a plurality of grooves 352 formed into the side wall 63 of the body 62 of the midsection 34 and a lock member 360 that is pivotably connected to a shroud 70 which extends downwardly from the bottom end of the upper unit 30. The lock member 360 includes a handle 361 that is pivotably connected to the shroud 70 such that the lock member 360 can pivot about a pivot shaft 362 between the locked position and the unlocked position, for example in the direction of arrows 94. A protrusion 364 extends out from a back side of the handle 361 and is configured to selectively engage one of the grooves 352 formed in the midsection body 62.

In the unlocked position, the protrusion 364 is disengaged from the grooves 352 and the lower unit 32 and the second cylinder 106 are extendable and retractable relative to the upper unit 30 and the first cylinder 104, for example in the direction of arrow 90. To lock the locking mechanism 350, the lock member 360 can be pivoted about the pivot shaft 362 to move the protrusion 364 into engagement with a groove 352 in the midsection body 62. In the locked position, the lower unit 32 and the second cylinder 106 are fixed relative to the upper unit 30 and the first cylinder 104, thereby retaining the lower unit 32 in the desired position.

In the embodiments of FIGS. 6 and 7, the locking mechanisms 300, 350 are configured to secure the second cylinder 106 and the lower unit 32 in one of a plurality of individual, discrete positions relative to the first cylinder 104 and the upper unit 30. Each of the possible positions corresponds to a pair if corresponding openings 316 or a groove 352 formed in the midsection body 62. Some embodiments, however, may be differently configured. For example, a locking mechanism may be configured to retain the lower unit 32 in any desired position (i.e., without multiple, discrete possible positions) with an adjustable friction engagement mechanism.

This written description uses examples to disclose the invention and also to enable any person skilled in the art to make and use the invention. Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention is defined by the claims and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. An extension joint device for a marine drive, the extension joint device comprising:

a first cylinder;

a second cylinder that is telescopically extendable and retractable relative to the first cylinder to adjust a length of the extension joint device;

wherein together the first and second cylinders define a sealed cylindrical cavity which is extended and retracted upon extension and retraction of the second cylinder relative to the first cylinder, respectively;

an electrical connector extending through the extension joint device, the electrical connector having a helical shape in the sealed cylindrical cavity which is extended and compressed upon extension and retraction of the second cylinder relative to the first cylinder; and a slip ring through which the electrical connector extends, wherein the slip ring is configured to permit rotation of a first portion of the electrical connector relative to a second portion of the electrical connector, thereby facilitating compression and extension of the helical shape.

2. The extension joint device according to claim 1, wherein the slip ring is disposed on one end of the sealed cylindrical cavity.

3. The extension joint device according to claim 1, wherein the slip ring comprises a stationary part and a rotatable part which is rotatable relative to the stationary part.

4. The extension joint device according to claim 3, wherein the rotatable part is disposed in the sealed cylindrical cavity.

5. The extension joint device according to claim 3, wherein the slip ring comprises an annular contactor and a point contactor which remains coupled to the annular contactor as the rotatable part is rotated relative to the stationary part.

6. The extension joint device according to claim 1, wherein the electrical connector comprises a first connector cable and a second connector cable which are intertwined to form a double helical shape.

7. The extension joint device according to claim 6, further comprising sliding seals between the first cylinder and the second cylinder.

8. The extension joint device according to claim 1, further comprising an actuator configured to move the second cylinder relative to the first cylinder.

9. The extension joint device according to claim 8, wherein the actuator comprises a hydraulic pump which pumps a hydraulic fluid into an annulus between the first and second cylinders so as to move the second cylinder relative to the first cylinder.

10. The extension joint device according to claim 1, further comprising a locking mechanism movable into and between an unlocked position in which the second cylinder is extendable and retractable relative to the first cylinder and a locked position in which the second cylinder is fixed relative to the first cylinder.

11. The extension joint device according to claim 10, wherein the locking mechanism is configured to selectively secure the second cylinder in one of a plurality of positions relative to the first cylinder.

12. The extension joint device according to claim 1, wherein the electrical connector comprises an over-molded wire, and further comprising a protective sheath containing the electrical connector, wherein the protective sheath reduces frictional abrasion of the electrical connector during movement of the second cylinder relative to the first cylinder.

13. The extension joint device according to claim 12, wherein the electrical connector comprises a first connector cable and second connector cable which are intertwined, and wherein the protective sheath includes a first helical sleeve and a second helical sleeve on the first and second connector cables, respectively, wherein the first and second connector cables and first and second protective sheaths forming a double helical shape.

14. The extension joint device according to claim 12, wherein the protective sheath has a helical shape and contains the helical shape of the electrical connector.

15. The extension joint device according to claim 14, wherein the helical shapes of the protective sheath and the electrical connector are extended and compressed upon extension and retraction, respectively, of the second cylinder relative to the first cylinder.

16. The extension joint device according to claim 13, wherein the protective sheath is made of an abrasion resistant material that is elastically deformable.

17. The extension joint device according to claim 1, further comprising a protective sheath, the protective sheath having a helical shape and containing the helical shape of the electrical connector.

18. The extension joint device according to claim 17, wherein the helical shapes of the protective sheath and the electrical connector are extended and compressed upon extension and retraction, respectively, of the second cylinder relative to the first cylinder.

19. The extension joint device according to claim 17, wherein the protective sheath has an upper helical section and a lower helical section, wherein the upper helical section is formed in a first circumferential direction about a vertical axis defined by the cylindrical cavity and the lower helical section is formed in a second circumferential direction about a vertical axis that is opposite the first circumferential direction.

20. The extension joint device according to claim 19, wherein the upper helical section extends from a top end that is fixed relative to the vertical axis to a bottom end that is connected to the lower helical section;

wherein the lower helical section extends from a top end that is connected to the lower end of the upper helical section to a bottom end of the lower helical section that is fixed relative to the vertical axis; and wherein extension and retraction of the second cylinder relative to the first cylinder causes a connection point between the upper helical section and the lower helical section to move about the vertical axis in the first circumferential direction and the second circumferential direction, respectively.

* * * * *